US007584952B2

(12) United States Patent
Gladwin et al.

(10) Patent No.: US 7,584,952 B2
(45) Date of Patent: Sep. 8, 2009

(54) SHEET FEEDING ASSEMBLY

(75) Inventors: Roy Norman Gladwin, Aylesbury (GB); Richard Thomas Calhoun Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 276 days.

(21) Appl. No.: 11/612,216

(22) Filed: Dec. 18, 2006

(65) Prior Publication Data

US 2008/0143041 A1 Jun. 19, 2008

(51) Int. Cl.
*B65H 3/06* (2006.01)

(52) U.S. Cl. ..... 271/115; 271/116

(58) Field of Classification Search ..... 271/114, 271/115, 116, 117
See application file for complete search history.

(56) References Cited

U.S. PATENT DOCUMENTS 6,168,153 B1 1/2001 Richards et al.
6,338,483 B1 1/2002 Andela et al.
6,592,117 B2 * 7/2003 Kuo et al. ..... 271/10.01
6,651,972 B2 * 11/2003 Hsiao et al. ..... 271/114
6,969,058 B2 * 11/2005 Gaarder et al. ..... 271/10.04
6,994,341 B2 * 2/2006 Aoki et al. ..... 271/117
7,275,741 B2 * 10/2007 Worley et al. ..... 271/117

* cited by examiner

*Primary Examiner*—Kaitlin S Joerger
(74) *Attorney, Agent, or Firm*—Oliff & Berridge, PLC

(57) ABSTRACT

A sheet from the top of a stack of media, and is driven by a reversible electric motor operated in a forward direction to drive a feed roll and nudger roll; and operated in a reverse direction to drive a cam profiled to raise and lower the nudger roll. One-way clutched gears may be provided to restrict rotation of the feed roll and the nudger roll when the motor is operated in a reverse direction; and to restrict rotation of the cam when the motor is operated in a forward direction. A rotary cam may be profiled to allow for the reciprocating movement of the nudger roll from a down position in which the nudger roll contacts the top of the stack of media to an up position in which the distance between the nudger roll and the top of the stack of media is suitable for loading media onto the stack of media.

24 Claims, 9 Drawing Sheets

SHEET FEEDING ASSEMBLY

BACKGROUND

Reproduction apparatuses typically include sheet feeding mechanisms to reliably feed individual sheets of media from a stack of media. For a given mechanism there is an optimum window, or vertical range, within which the top of the media stack must be presented to one or more feed rolls for reliable performance. This has been traditionally achieved using an elevating plate and associated elevating mechanism for raising and lowering the media stack to position the top of the media stack within the optimum window relative to the feed rolls. In the operating mode, a nudger roll, also commonly referred to as a pre-feed roll, is positioned above the media stack in contact with the top of the media stack. Rotation of the nudger roll engages the top sheet of the media stack, causing the sheet to begin moving from the media stack to a feed path.

In addition to the use of an elevating plate, conventional media feeder mechanisms also rely on the use of solenoid with the nudger roll. The solenoid operates to lower the nudger roll from an up position above the top of the media stack to a down position engaging the top of the media stack. The operations of an elevated plate mechanism and nudger roll solenoid are coordinated. With the elevated plate in a lowered position and the nudger roll in an up position, an operator can add media to the media stack.

To allow for increased media capacity, feeding mechanisms should accommodate reasonably large stack heights. Larger stack heights increase the complexity of both elevating plate mechanisms used to raise the media stacks and nudger roll solenoids. There are significant disadvantages associated with these mechanisms in the form of high manufacturing and maintenance costs.

SUMMARY

There is a need for feeding mechanisms that can reliably feed various types of media to marking devices or imaging devices without utilizing either a media stack raising mechanism and/or a solenoid operated mechanism for moving the nudger rolls. Eliminating the use of these mechanisms would eliminate the need for costly parts, such as solenoids, and thereby reduce manufacturing costs. Eliminating the use of a solenoid, which is inherently noisy, also provides the benefit of reduced operating noise.

Conventional feeding mechanisms employ motors to drive the feed and nudger rolls, and to operate the elevated plate mechanism. These motors are often reversible electric stepper motors, which in many cases are only operated in a single direction. There is a need for a feeding mechanism that better utilizes the capacity of reversible electric stepper motor by operating it in both of its available directions.

In embodiments, a sheet feeding assembly is provided that reliably feeds various types of media to a marking device or imaging device without requiring an elevated plate mechanism for raising and lowering a stack of media.

In embodiments, a sheet feeding assembly is provided that reliably feeds various types of media to marking devices or imaging devices without requiring a solenoid operated nudger roll.

In embodiments, a sheet feeding assembly is provided that is less expensive to manufacture and repair.

In embodiments, a sheet feeding assembly is provided that operates a reversible electric stepper motor in both directions. The assembly may include a frame with opposing sides connected by a cross member, a feed roll supported on the frame for rotation about a feed axis, a nudger support element pivotally mounted to the frame for rotational movement about a feed axis, and a nudger roll connected to the nudger support element for rotation about a nudger axis parallel to the feed axis. The assembly further includes a cam supported on the frame for rotation about a cam axis. The cam engages an extension member of the nudger support element extending outwardly from the feed axis, and is profiled to raise and lower the nudger roll as the cam rotates. The assembly further includes a reversible electric stepper motor to drive, without requiring the use of more than one motor, the feed roll, nudger roll and cam.

In embodiments, the feed roll and the nudger roll are driven in a forward direction when the motor is operated in a forward direction; and the cam is driven in a cam operating direction when the motor is operated in a reverse direction. This provides greater utilization of the capabilities of a reversible electric stepper motor than provided by feeder mechanisms that operate the stepper motor in only one direction. The sheet feeding assembly reliably feeds various types of media to marking devices or imaging devices without the need for an elevating plate mechanism or a solenoid operated nudger roll.

These and other objects, advantages and salient features are described in or apparent from the following detailed description of exemplary embodiments.

BRIEF DESCRIPTION OF THE DRAWINGS

Exemplary embodiments will be described with reference to the drawings, wherein like numerals represent like parts, and wherein.

DETAILED DESCRIPTION OF EMBODIMENTS

The sheet feeding assembly described herein is discussed in the context of a marking device, for purposes of illustration. However, the feeding assembly could be implemented in any type of marking device or imaging device, such as a printer, facsimile machine, scanner, or a xerographic marking device or any other device that feeds sheet material through a feed path.

Figure 1:
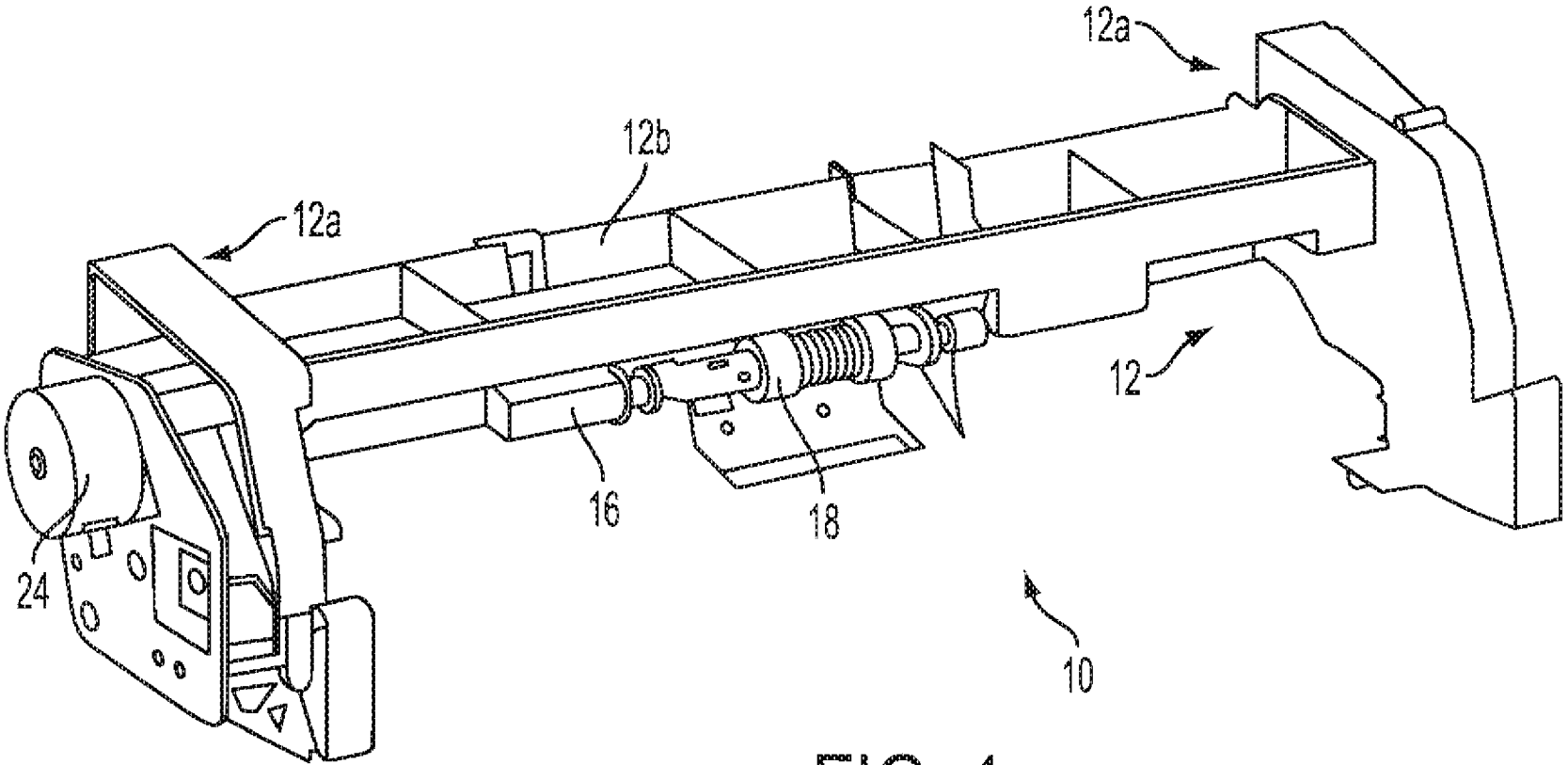
FIG. 1 is a perspective view of an exemplary embodiment of a sheet feeding assembly.
Figure 4:
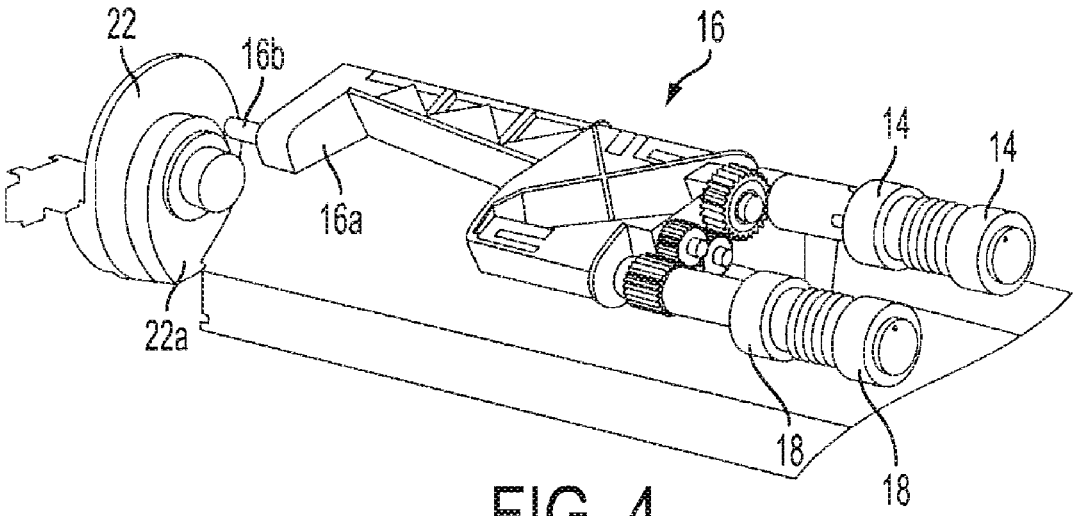
FIG. 4 is a perspective view of an exemplary embodiment of a nudger support element and nudger roll in a down position.
Figure 5:
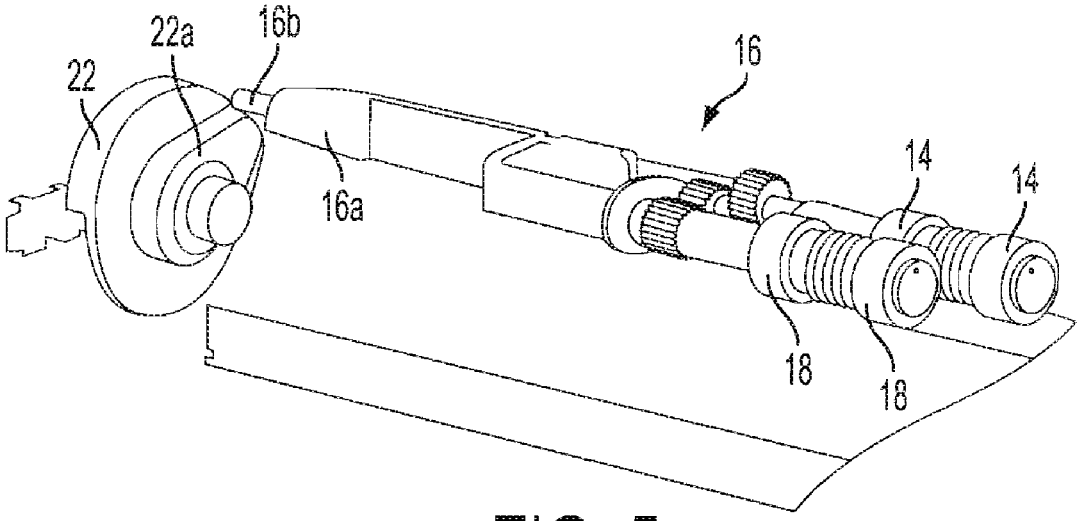
FIG. 5 is a perspective view of an exemplary embodiment of a nudger support element and nudger roll in an up position.
Figure 7:
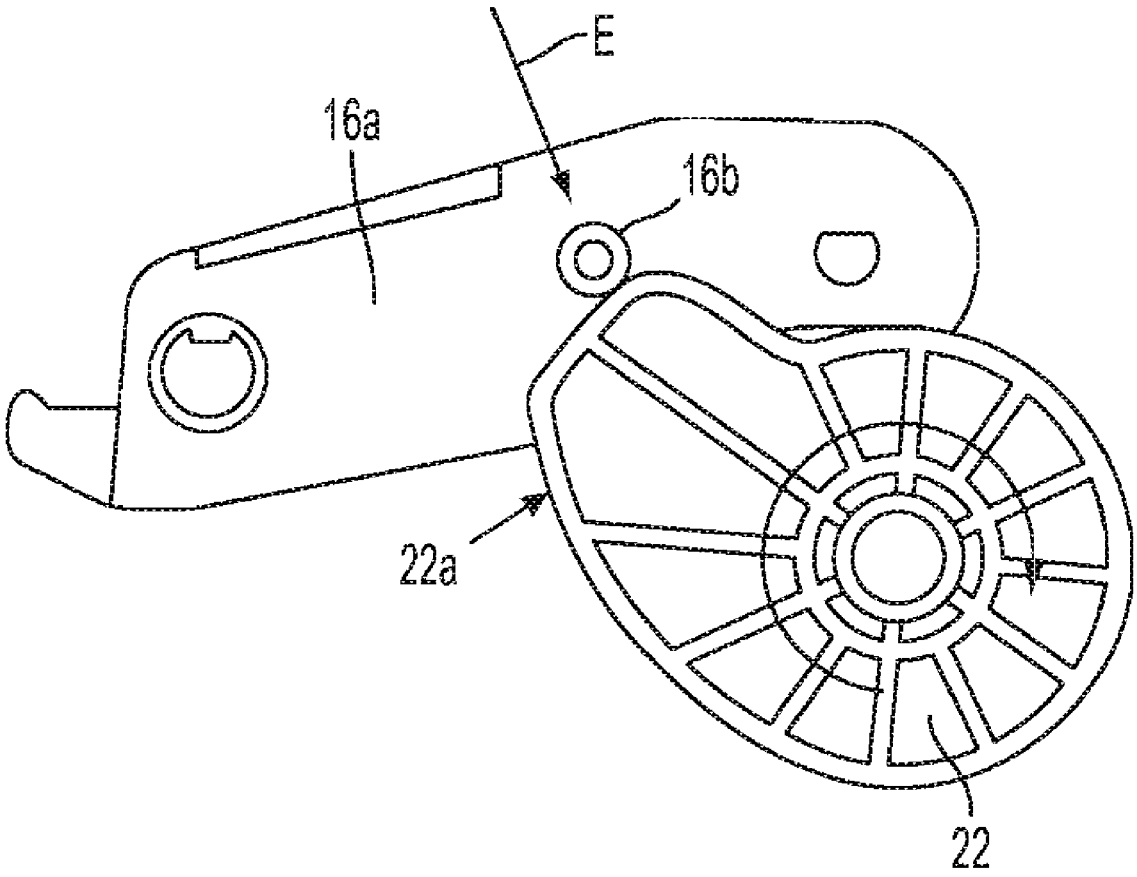
FIG. 7 is a side view of an exemplary embodiment of a cam and nudger support element extension member.

FIG. 1 illustrates an exemplary embodiment of a sheet feeding assembly 10 for feeding a sheet from the top of a stack of media to a feed path. The sheet feeding assembly 10 has a frame 12 comprising opposing sides 12*a* connected by a cross member 12*b*. A feed roll 14 is supported on the frame 12 for rotation about a feed axis identified as A-A in FIGS. 2, 3 and 7. The sheet feeding assembly further comprises a nudger support element 16 is supported on the frame 12 for pivotal movement about the feed axis A-A. As shown in FIGS. 4-5 and 7-8, the nudger support element has an extension member 16*a* extending outwardly radially from the feed axis A-A. As shown in FIGS. 4-5 and 7, the extension member 16*a* of the nudger support element engages a rotary cam 22 at, for instance, a cam follower 16*b* protruding from the extension member 16*a*.

Figure 2:
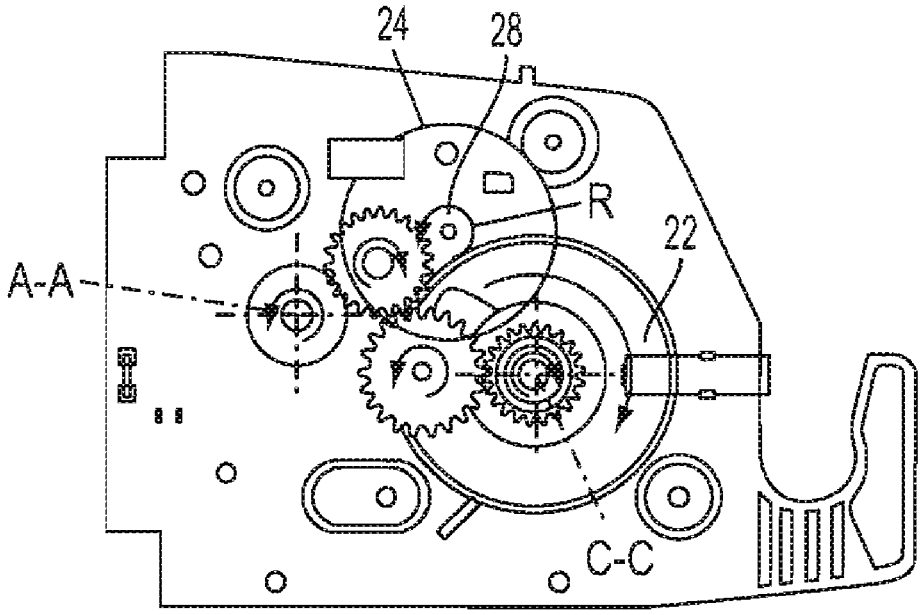
FIG. 2 is a left side view of the sheet feeding assembly of FIG. 1.
Figure 3:
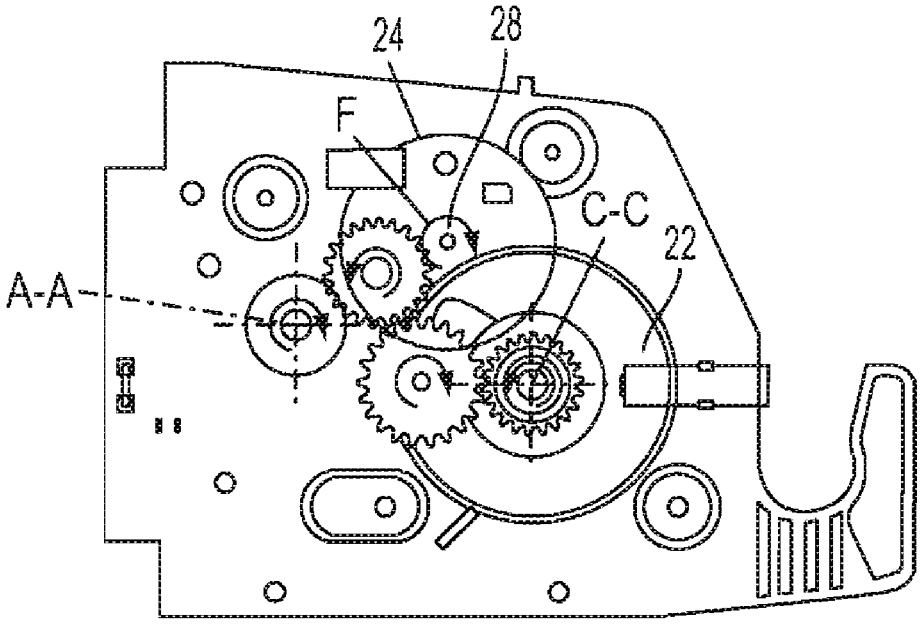
FIG. 3 is a another left side view of the sheet feeding assembly of FIG. 1.
Figure 6:
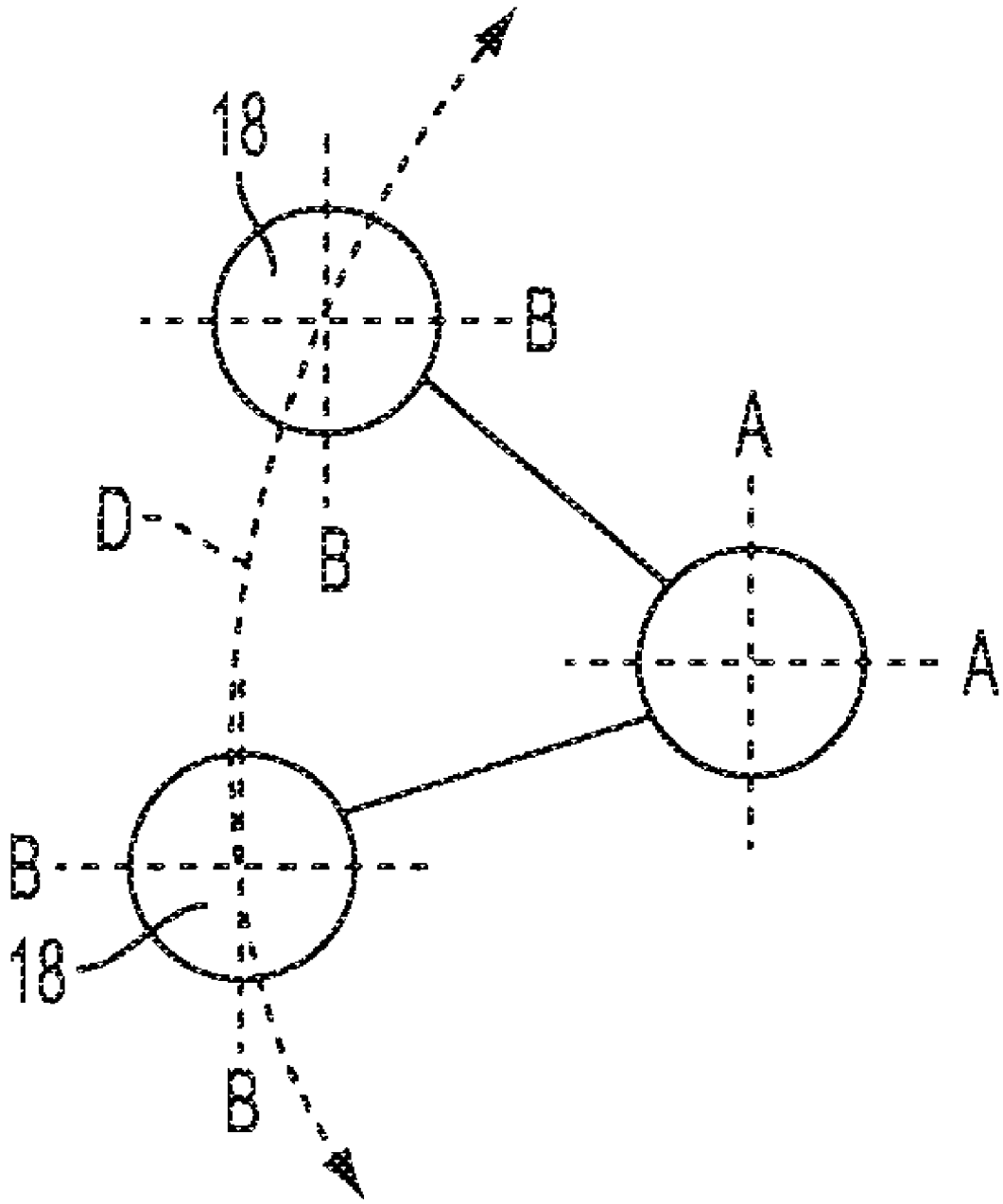
FIG. 6 is a side sectional view of an exemplary embodiment of a nudger support element and nudger roll.

A nudger roll 18 is connected to the support element 16 for rotation about a nudger axis, shown as B-B in FIGS. 2, 3 and 6, that is positioned parallel to the feed axis A-A. A rotary cam 22 supported on the frame 12 for rotation about a cam axis shown as C-C in FIGS. 2, 3 and 7. As shown in FIG. 7, the cam 22 is positioned and profiled for engagement with a portion of the support element extension member 16*a*, such as the cam follower 16*b* protruding therefrom. In the depicted embodiment, a reversible electric stepper motor 24 drives the feed roll 14, nudger roll 18 and cam 22.

The sheet feeding assembly 10 may include a gear train assembly 20 intermediate the motor 24 and some or all of the feed roll 14, nudger roll 18, and rotary cam 22. The motor 24 may directly drive one of these elements, making a gear train assembly unnecessary for that element. The feed roll 14 and nudger roll 18 each have a surface suitable for engaging the surface of a sheet of media, such as may be required to slidably remove a sheet of media from the stack of media. The feed roll 14 or nudger roll 18 may include single or multiple rollers or coaxially mounted wheels or conveying belts for moving single sheets of media.

As shown in FIG. 3 by arrow F, the feed roll 14 is driven in a forward direction when the motor 24 is operated in a forward direction. The forward direction of the motor 24 is the direction of operation that provides for driving the feed roll 14 and nudger roll 22 in a direction that allows the feed roll 14 and nudger roll 22 to feed a sheet from the top of a stack to a feed path of a marking device or imaging device. In the exemplary embodiment shown on the left side views provided in FIGS. 2 and 3, with the motor 24 mounted to a gear plate 26 and attached to the left side of the frame 12, a forward rotation of the motor 24 is represented by a clockwise rotation of the motor pinion 28. This causes a clockwise rotation of the feed roll 14, feed shaft 15, nudger roll 18, and nudger shaft 19 so that sheets are fed from the top of a stack of media from right to left under the nudger roll 18 and then under the feed roll 14.

When the motor 24 is operated in a reverse direction as shown in FIG. 2 by arrow R, the rotary cam 22 rotates. In the exemplary embodiment shown on the left side views provided in FIGS. 2 and 3, a reverse rotation of the motor 24 causes a clockwise rotation of the rotary cam 22 as viewed from the perspective of FIGS. 2 and 3. This is also shown from a right side view in FIG. 7 as a clockwise rotation of the rotary cam 22.

Figure 8:
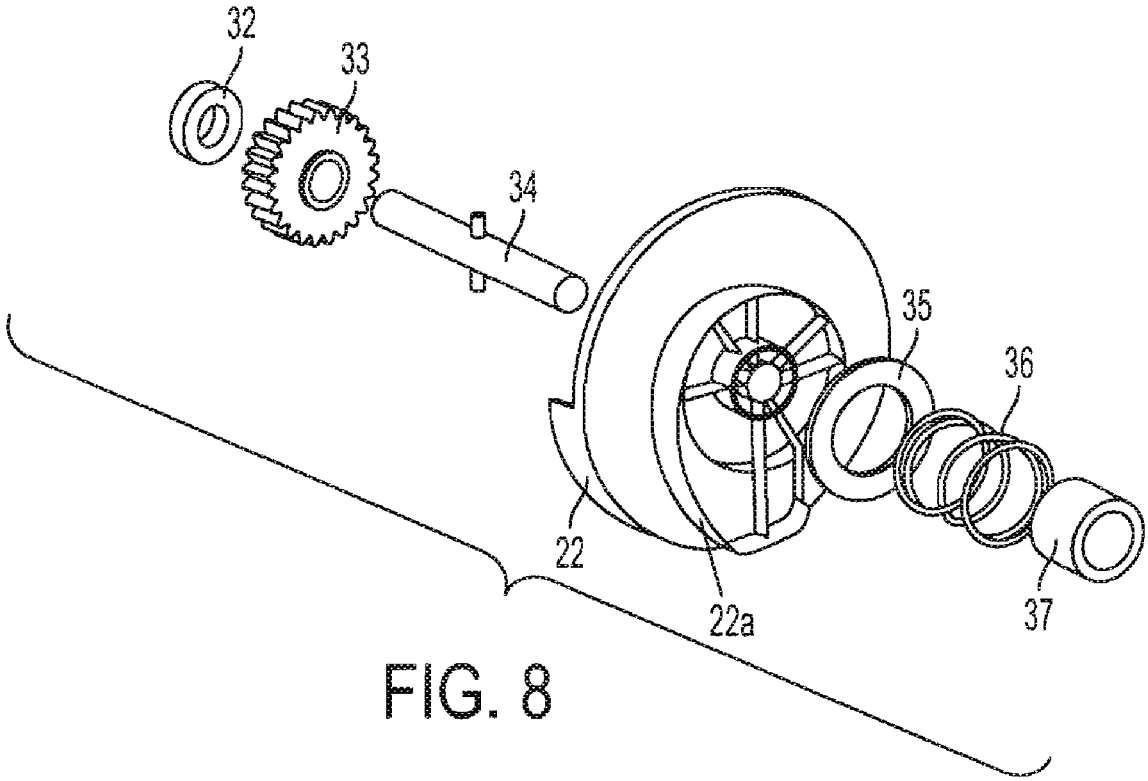
FIG. 8 is an exploded view of an exemplary embodiment of a cam and one-way clutched gear.

The gear train assembly may comprise a first one-way clutch connected to the nudger roll and a second one-way clutch connected to the feed roll. A third one-way clutched gear 33 may be connected to the camshaft 34 which is directly connected to the cam 22. The camshaft 34 is also connected to a further one-way clutch housing 37, which is shown in FIG. 8. Each of the one-way clutches restricts rotation of the respective feed roll 14, nudger roll 18, and cam 22 when the rotation of their respective drive shafts is opposite to the operational direction of the cam 22. For the feed roll 14 and nudger roll 18, the one-way clutch restricts rotation of the feed roll 14 and the nudger roll 18 in a reverse direction, i.e., opposite to the direction used to feed sheets, when the motor 24 is operated in a reverse direction. The one-way clutch housing 37 connected to the cam 22 via the camshaft 34 restricts rotation of the cam 22 in a direction opposite to the normal cam 22 operating direction when the motor 24 is operated in a forward direction, i.e., a direction that feeds sheets.

The cam 22 is profiled to move the nudger support element 16 and nudger roll 18 between an up position suitable for loading media onto the stack of media, shown in FIG. 5, and a down position suitable for operation of the nudger roll 18, shown in FIG. 4.

An exemplary profile of the cam 22 is shown in FIG. 7. The cam 22 has a profile 22*a* that is slidingly engaged by the cam follower 16*b* of the nudger support element as the nudger roll 18 is lifted from and lowered to its down position. Cams having other profiles configured to provide for movement of a nudger roll 18 between a suitable up and down position upon rotation of the cam 22 may be used. In the exemplary embodiment, the nudger support element 16 is pivotally mounted to the frame 12 to provide for pivotal rotation about the feed axis A-A. The nudger roll 18 travels from its up and down positions along an arc D shown in FIG. 6.

An exemplary cam 22 and one-way clutched gear are illustrated in FIG. 8. These components comprise a bearing 32, clutched gear 33, cam shaft 34, cam thrust washer 35, cam thrust spring 36 and clutch housing 37 as well as the cam 22 itself. The spring loaded cam thrust washer 35 assists the other components of the clutched gear mechanism in keeping the cam 22 correctly in place such as by restricting over rotation, due to forces of inertia, and by restricting the cam from rotating in a forward direction due to machine vibration.

The sheet feeding assembly 10 may further comprise a biasing member (not shown) for biasing the nudger support element 16 and the nudger roll 18 toward the down position. The biasing may be of a form well-known in the art, such as but not limited to a spring.

The force applied by the biasing member may be tangential to the arc traveled by the nudger roll 18 as it travels between the up and down positions. The biasing force assists in maintaining contact between the nudger roll 18 and the top of the stack of media at a constant force, when the nudger roll 18 is in the down position. The cam 22 may be profiled to provide for the biasing force to assist in maintaining the cam in a stationary position when the nudger roll 18 is in the up position. FIG. 7 provides a side view of the position of the cam 22 with the nudger roll 18 in the up position. The direction of operation of the cam 22 is clockwise. The biasing force is applied from the nudger support element 16 to the cam 22 in the direction shown as E in FIG. 7. This biasing force urges the cam 22 to rotate in a counterclockwise direction that is opposite to its direction of operation. The rotational movement of the cam 22 in this direction is restricted by operation of the one-way clutched gear, so the biasing force assists in keeping the cam 22 in a generally locked position. Thus, the depicted cam 22 is profiled so that when the nudger support element 16 is in the up position, the biasing member assists in maintaining the cam 22 in a stationary position by urging the cam 22 to rotate in a direction opposite to the cam 22 operating direction, which is restricted by the one-way clutched gear.

In this manner, it may be appreciated that during normal operation of the marking device or imaging device, the nudger roll 18 is in the down position on top of the media stack. The motor 24 operates in the forward direction to drive the nudger roll 18 to allow sheet feeding. The cam 22 is essentially disengaged and maintained in a stationary position. The cam 22 is rotated to the position shown in FIG. 7 when there is a need to raise the nudger roll 18 above the top surface of the media stack for instance, to add media to the stack. In this raised position, the nudger roll 18 is essentially disengaged from the stack, and remain in a stationary position. To resume sheet feeding, the cam 22 rotates to reposition the nudger roll 18 in the down position, i.e., to drop the nudger roll 18 onto the top surface of the media stack. The raising and lowering of the nudger roll 18 is caused by the rotation of the cam 22, which in turn results from the operation of the motor 24 in the reverse direction. The timing and duration of raising and lowering of the nudger roll 18 is controlled by the selective operation of the motor 24 in the reverse direction.

The sheet feeding assembly 10 may be part of a document handling assembly for use with a marking device or imaging device, including a photocopier of the xerographic type or other such type of printer, facsimile machine or scanner. For a general understanding of marking device, such as an electrophotographic printer, solid ink printer or copying machine, or an imaging device, such as a scanner, the exemplary embodiments according to this disclosure may be incorporated, reference is made to FIG. 9, which depicts schematically various components of a marking device. It should be apparent that this embodiment of a marking device is merely illustrative, and the sheet feeding assembly could be implemented in any type of marking device or imaging device.

Figure 9:
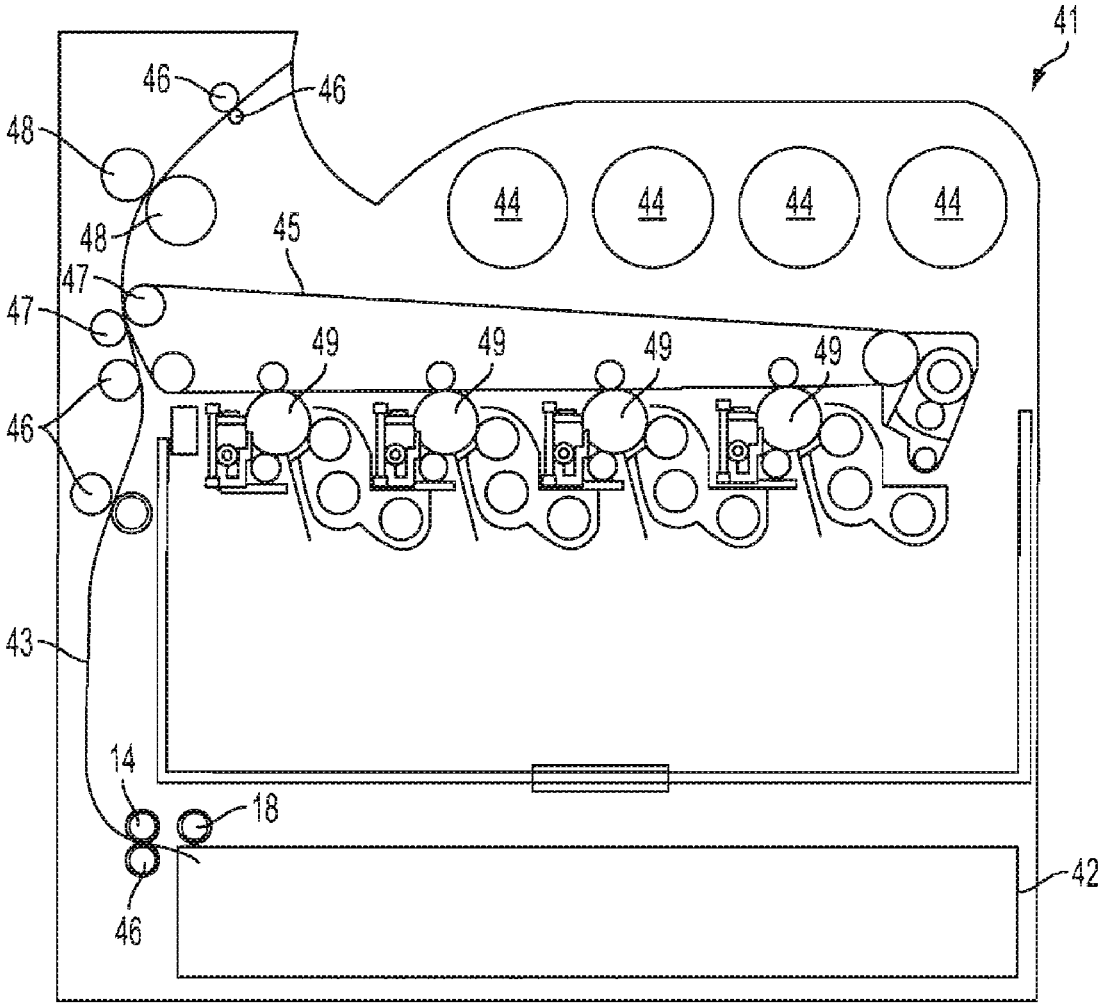
FIG. 9 is a schematic representation of an exemplary embodiment of a marking device having an exemplary embodiment of a sheet feeding assembly.

The exemplary marking device 41 shown in FIG. 9 comprises a cassette tray 42 for holding a stack of media 11, a portion of which is positioned below a nudger roll 18 depicted in the up position. In the operating mode, the nudger roll 18 and feed roll 14 are driven in a clockwise rotation to transfer a sheet of media from the top of the stack of media 11 to a feed path 43.

The exemplary marking device 41 provides for the transfer of four color toners (yellow, magenta, cyan and black) from a plurality of toner cartridges 44 onto a transfer belt 45. The sheet of media is transferred along the feed path 43 by a plurality of transfer rolls 46 in turn between the transfer belt 45 and one of two primary transfer rolls 47 and further between a pair of fixing rolls 48 brought into abutting contact with each other, and then delivered out of the housing of the marking device 41. The color toners are applied to the sheet of media upon contact of the sheet with the transfer belt 45. The toners are subsequently fixed to the sheet upon contact with the fixing rolls 48.

The exemplary marking device 41 further comprises an exposure unit such as a laser light source arranged within the housing of the marking device 41 at a specified position in the housing to irradiate surfaces of a plurality of rotating electrophotographic photoreceptors 49 after charging with laser light emitted from the laser light source. This performs the respective steps of charging, exposure, development, primary transfer and cleaning in turn in the rotation of the electrophotographic photoreceptors. Toner images of the respective colors are then transferred onto the transfer belt 45, one over the other prior to application onto the sheet of media.

The exemplary document handling assembly has a sheet feed path extending from an input tray containing a stack of single sheet media to an output past a feed roll 14. A nudger roll 18 is provided for selectively engaging a sheet at the top of the stack of media and driving the sheet into the paper path. Operatively connected to the nudger roll 18 is a rotary cam 22 for operating the nudger roll to the top of the stack of media. The document handling system is also provided with a reversible electric stepper motor 24 and a gear train assembly intermediate the motor 24 and each of the feed roll 14, nudger roll 18, and rotary cam 22. The gear train transmits power from the motor 24 to rotate the feed roll 14 and the nudger roll 18 when the motor 24 is operated in a forward direction and to transmit power to rotate the rotary cam 22 when the motor 24 is operated in a reverse direction.

Figure 10:
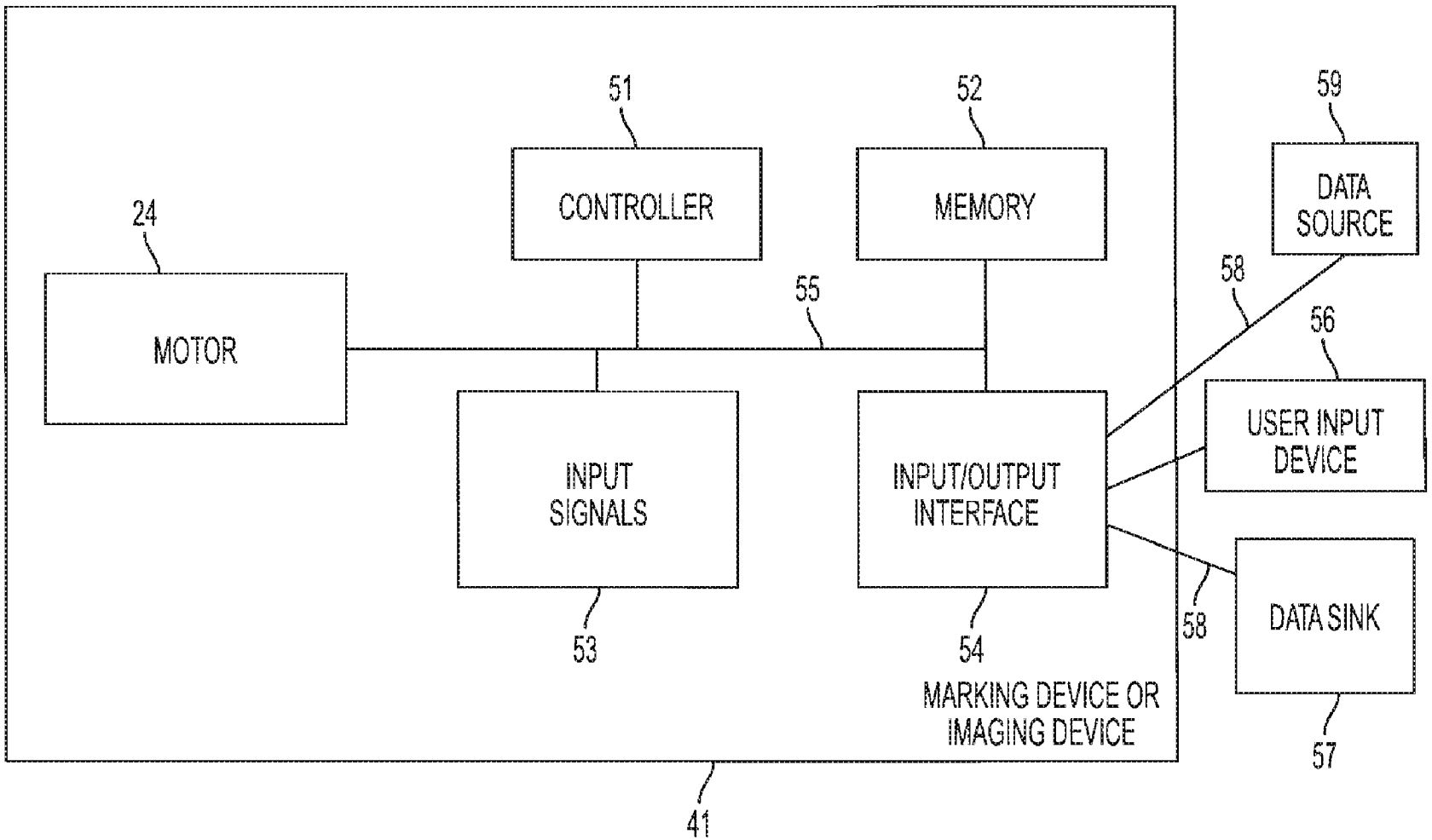
FIG. 10 is a functional block diagram illustrating an exemplary embodiment of a marking device.

FIG. 10 is a functional block diagram illustrating an exemplary embodiment of a marking device or imaging device 41, which includes a controller 51, memory 52, input signals 53, an input/output interface 54, and a motor 24, which are interconnected by a data/control bus 55. The controller 51 controls the operation of the nudger roll 14 via the motor 41 based on input signals 53 and/or other signals provided through an input/output interface 54. The input/output interface 54 may provide information from a user input device 56 and/or a data sink 57. The controller 51 performs any necessary calculations and executes any necessary programs for implementing the marking device or imaging device 41, and its individual components including the motor 24, and controls the flow of data between other components of the marking device 41 as needed.

The memory 52 may serve as a buffer for information coming into or going out of the marking device 41, may store any necessary programs and/or data for implementing the functions of the marking system 41, and/or may store data at various stages of processing. The memory 52, while depicted as a single entity, may actually be distributed. Alterable portions of the memory 52 are, in various exemplary embodiments, implemented using static or dynamic RAM. However, the memory 52 can also be implemented using a floppy disk and disk drive, a writeable optical disk and disk drive, a hard drive, flash memory or the like. The links 58 may be any suitable wired, wireless or optical links.

The data sink 57 can be any device that is capable of outputting or storing processed data. The data source 59 can be a digital camera, a scanner, or a locally or remotely located computer, or any other known or later developed device that is capable of generating electronic image data. Similarly, the data source 59 can be any suitable device that stores and/or transmits electronic image data, such as a client or a server of a network. The image data source 59 can be integrated with the marking device or imaging device 41, as in a digital copier having an integrated scanner. Alternatively, the data source 59 can be connected to the marking device or imaging device 41 over a connection device, such as a modem, a local area network, a wide area network, an intranet, the Internet, any other distributed processing network, or any other known or later developed connection device.

The controller 51 may base the operation of the motor 24 on one or more input signals 53 such as a signal from a position detector for the rotary cam 22. The position detector may be of any type known in the art such as a photo-interrupt sensor. In embodiments, a photo-interrupt sensor detects the rising edge of the integral vane 22*a* of the cam as it is rotated by the motor 24.

An additional input signal 53 may be provided in the form of a detector for the stack height of the stack of media. This detector may determine when there is a need to add media to the stack; at which point the controller 51 may place the nudger roll 18 in the up position by selectively operating the motor 24 in a reverse direction.

A one or more one-way clutched gear may also be provided to restrict rotation of the feed roll 14 and/or the nudger roll 18 when the motor 24 is operated in a reverse direction. An additional one-way clutched gear may be provided to restrict rotation of the cam 22 when the motor 24 is operated in a forward direction. The rotary cam 22 is profiled to allow the adjustment of the nudger roll 18 from a down position in which the nudger roll 18 contacts the top of the stack of media to an up position in which the distance between the nudger roll 18 and the top of the stack of media is suitable for loading media onto the stack of media.

Figure 11:
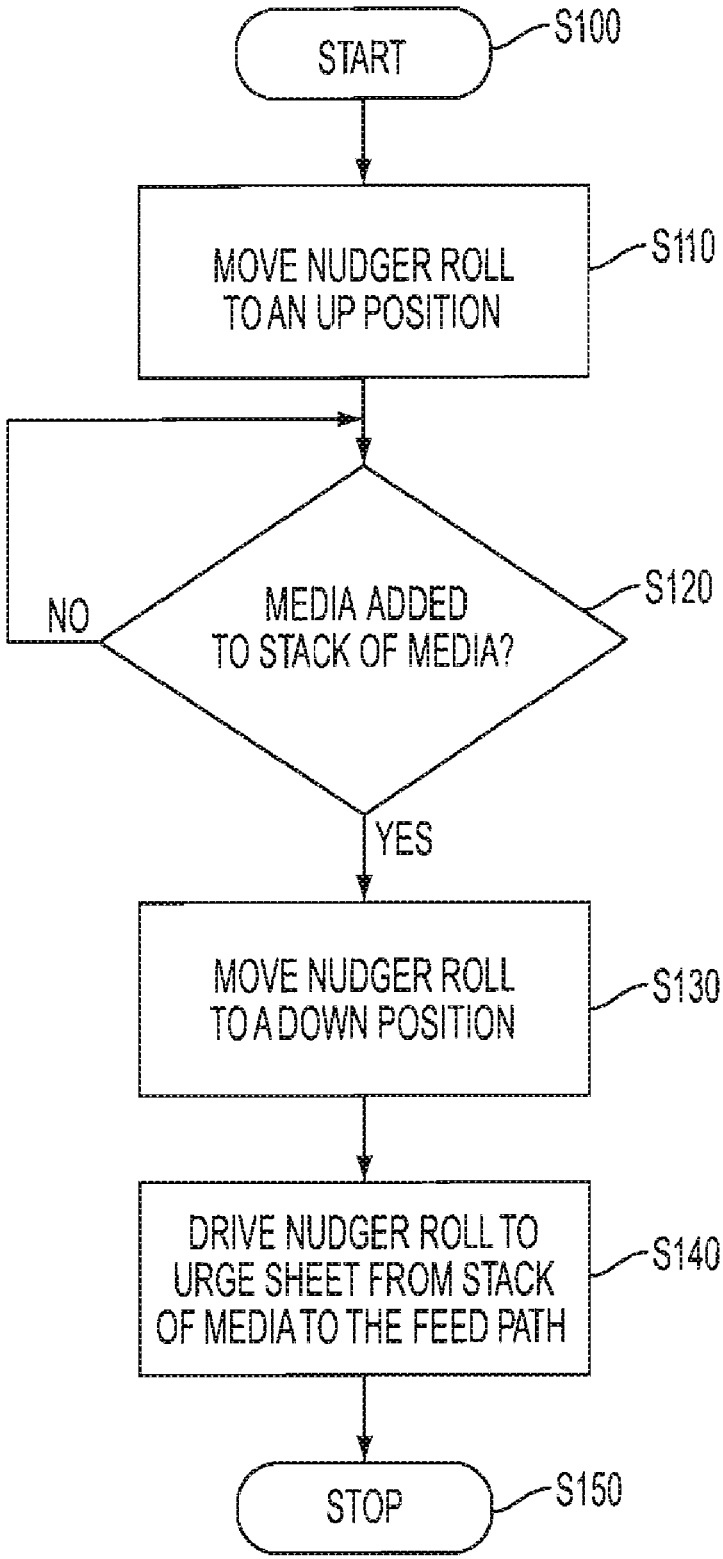
FIG. 11 is a flowchart illustrating an exemplary method of operating a sheet feeding assembly.

FIG. 11 illustrates an exemplary method of operating a sheet feeding assembly for feeding a sheet from the top of a stack of media to a feed path. The method includes a first step S110 of moving a nudger roll from a down position proximate the top of a stack of media to an up position. With the nudger roll in the up position, a user may add media to the stack of media to raise the height of the stack. At step S120, the method awaits a indication that media has been added. This may be done by, for example, receiving a manual input from the user indicating that media has been added, or by receiving a signal from a detector. The nudger roll is then moved from the up position to the down position in step S130. In step S140, the nudger roll is driven to urge a sheet from the stack of media to the feed path. Step S140, driving the nudger roll, may be accomplished by selectively operating a reversible electric stepper motor engaged with the nudger roll in a forward direction. Steps S110 and S130, wherein the nudger roll is moved between its up and down positions, may be accomplished by selectively operating a reversible electric stepper motor engaged with the nudger roll in a reverse direction. This may be accomplished by rotation of a rotary cam operatively engaged to the nudger roll.

The method may provide that when the nudger roll is being driven, the nudger roll 18 is maintained in a stationary position, which may be accomplished by restricting the rotation of the rotary cam. A controller may further be provided for a step of controlling the operation of the motor based on one or more input signals such as from a rotary cam position detector. The rotary cam position detector assists in coordinating the operation of the sheet feeding system and may be provided in the form of a photo-interrupt sensor.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A sheet feeding assembly for feeding a sheet from a stack of media to a feed path, comprising:

a frame;

a feed roll supported on the frame for rotation about a feed axis;

a nudger support element supported on the frame for pivotal movement about the feed axis, the support element including a cam follower, a nudger roll connected to the support element for rotation about a nudger axis parallel to the feed axis;

a cam supported on the frame for rotation about a cam axis, the cam being positioned for engagement with the cam follower; and a reversible electric stepper motor that drives the feed roll, the nudger roll and the cam, wherein the motor, feed roll, nudger roll and cam are constructed and arranged whereby when the reversible stepper motor is operated in a forward direction, the motor drives a feed roll and nudger roll in a forward direction, and when the reversible motor is operated in a reverse direction, the motor drives the cam in a cam operating direction.

2. A sheet feeding assembly as described in claim 1 further comprising a gear train assembly intermediate the motor and each of said feed roll, nudger roll, and rotary cam.

3. A sheet feeding assembly as described in claim 2 wherein the feed roll and the nudger roll are driven in a forward direction when the motor is operated in a forward direction; and the cam is driven in a cam operating direction when the motor is operated in a reverse direction.

4. A sheet feeding assembly as described in claim 3 wherein the gear train assembly comprises a first one-way clutched gear connected to the nudger roll and a second one-way clutched gear connected to the feed roll to restrict rotation of the nudger roll and feed roll in a reverse direction when the motor is operated in a reverse direction.

5. A sheet feeding assembly as described in claim 3 wherein the gear train assembly comprises a one-way clutched gear connected to the cam to restrict rotation of the cam in a direction opposite to the cam operating direction when the motor is operated in a forward direction.

6. A sheet feeding assembly as described in claim 5 wherein the cam is profiled to move the nudger support element and nudger roll between an up position suitable for loading media onto the stack of media and a down position suitable for operation of the nudger roll.

7. A sheet feeding assembly as described in claim 6 further comprising a biasing member connected to nudger support element for biasing the nudger support element and the nudger roll toward the down position.

8. A sheet feeding assembly as described in claim 7 wherein the cam is profiled so that when the nudger support element is in the up position, the biasing member assists in maintaining the cam in a stationary position by urging the cam to rotate in a direction, opposite to the cam operating direction, which is restricted by the one-way clutched gear.

9. A xerographic marking device incorporating the sheet feeding assembly of claim 1.

10. A marking device or imaging device incorporating the sheet feeding assembly of claim 1.

11. A document handling assembly, comprising:

a sheet feed path extending from an input tray containing a stack of single sheet media to an output past a feed roll;

a nudger roll that selectively engages a sheet at the top of the stack of media and drives the sheet into the paper path;

a rotary cam operatively connected to the nudger roll for selectively adjusting a distance between the nudger roll and the top of the stack of media;

a reversible electric stepper motor;

a gear train assembly intermediate the motor and each of the feed roll, nudger roll, and rotary cam in a cam operating direction provided to transmit power from the motor to rotate the feed roll and the nudger roll in a forward direction when the motor is operated in a forward direction and to transmit power to rotate the rotary cam when the motor is operated in a reverse direction; and a controller connected to the motor that controls the operation of the motor based on input of a rotary cam position detector.

12. A document handling assembly as described in claim 11 wherein the rotary cam position detector is a photo-interrupt sensor.

13. A document handling assembly as described in claim 11 wherein the controller controls the operation of the motor based also on input of a stack height detector.

14. A document handling assembly as described in claim 11 wherein the gear train assembly comprises a one-way clutched gear connected to each of the nudger roll and the feed roll to restrict rotation of the feed roll and the nudger roll when the motor is operated in a reverse direction.

15. A document handling assembly as described in claim 11 wherein the gear train assembly comprises a one-way clutched gear connected to the rotary cam to restrict rotation of the cam when the motor is operated in a forward direction.

16. A document handling assembly as described in claim 11 wherein the rotary cam is profiled to adjust the nudger roll from a down position in which the nudger roll contacts the top of the stack of media to an up position in which the distance between the nudger roll and the top of the stack of media is suitable for loading media onto the stack of media.

17. A xerographic marking device incorporating the document handling assembly of claim 11.

18. A marking device or imaging device incorporating the document handling assembly of claim 11.

19. A method of operating a sheet feeding assembly for feeding a sheet from the top of a stack of media to a feed path, comprising:

moving a nudger roll from a down position proximate the top of a stack of media to an up position;

adding media to the stack of media;

moving the nudger roll from the up position to the down position; and driving the nudger roll to urge the sheet from the stack of the media to the feed path, wherein the driving step comprises selectively operating a reversible electric stepper motor engaged with the nudger roll in a forward direction; and the moving steps comprise selectively operating the reversible electric stepper motor in a reverse direction.

20. A method of operating a sheet feeding assembly as described in claim 19, further comprising maintaining the nudger roll in a stationary position during the driving step.

21. A method of operating a sheet feeding assembly as described in claim 20, wherein the moving steps comprise driving a rotary cam operatively engaged to the nudger roll and the maintaining step comprises restricting the rotation of the rotary cam during the driving step.

22. A method of operating a sheet feed assembly as described in claim 20 further comprising controlling the operation of the motor based on the input of a rotary cam position detector.

23. A method of operating a sheet feed assembly of a xerographic marking device as described in claim 20.

24. A method of operating a sheet feed assembly of a marking device or imaging device as described in claim 20.

* * * * *